US008475182B2

(12) United States Patent
Li et al.

(10) Patent No.: US 8,475,182 B2
(45) Date of Patent: Jul. 2, 2013

(54) BOARD-TO-BOARD CONNECTOR

(75) Inventors: Tsung-Hsi Li, Tu-Cheng (TW); Ming-Chih Hsieh, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 207 days.

(21) Appl. No.: 13/081,469

(22) Filed: Apr. 6, 2011

(65) Prior Publication Data

US 2012/0164853 A1 Jun. 28, 2012

(30) Foreign Application Priority Data

Dec. 28, 2010 (TW) ..... 99146259 A

(51) Int. Cl.
*H01R 12/00* (2006.01)

(52) U.S. Cl.
USPC ..... 439/74

(58) Field of Classification Search
USPC ..... 439/65, 74, 78, 563–571
See application file for complete search history.

(56) References Cited

U.S. PATENT DOCUMENTS

| | | | | |
|---|---|---|---|---|
| 4,579,404 | A * | 4/1986 | Lockard | 439/92 |
| 5,382,168 | A * | 1/1995 | Azuma et al. | 439/65 |
| 5,783,536 | A * | 7/1998 | Farrell et al. | 510/141 |
| 6,042,423 | A * | 3/2000 | Murr et al. | 439/590 |
| 6,135,787 | A * | 10/2000 | Byrd et al. | 439/78 |
| 6,702,590 | B2 * | 3/2004 | Zaderej et al. | 439/74 |
| 8,292,636 | B2 * | 10/2012 | Hsieh et al. | 439/74 |

FOREIGN PATENT DOCUMENTS

CN 1253667 A 5/2000

* cited by examiner

*Primary Examiner* — Xuong Chung Trans
(74) *Attorney, Agent, or Firm* — Altis Law Group, Inc.

(57) ABSTRACT

A board-to-board connector includes a double plastic pin header connector and a supporting plate. The double plastic pin header connector includes two opposite positioning plates, and a number of pin headers arranged in two rows and extending through the positioning plates. The supporting plate is placed between the two rows of pin headers, with opposite ends of the supporting plate resisting against the corresponding positioning plates.

6 Claims, 3 Drawing Sheets

BOARD-TO-BOARD CONNECTOR

BACKGROUND

1. Technical Field

The present disclosure relates to a board-to-board connector.

2. Description of Related Art

There are many types of board-to-board connectors to electrically connect two circuit boards together. One type of board-to-board connector is called a pin header connector. This type of board-to-board connector includes a plurality of pin headers. In use, the heights of the pin headers may be different according to different circuit boards. When the heights of the pin headers are too high, the pin headers can be deformed in processing of being plugged into or disassembled from two circuit boards, which is undesirable.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
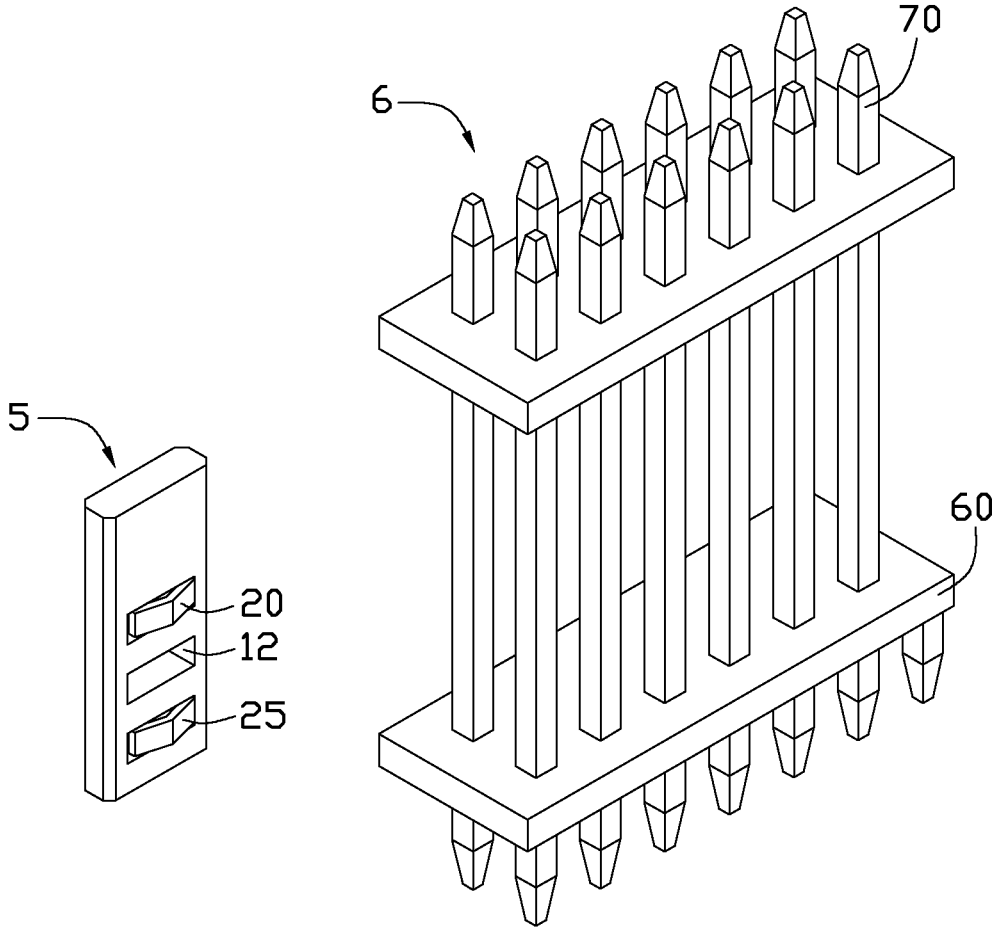
FIG. 1 is an exploded, isometric view of an exemplary embodiment of a board-to-board connector, the board-to-board connector includes a supporting plate.
Figure 2:
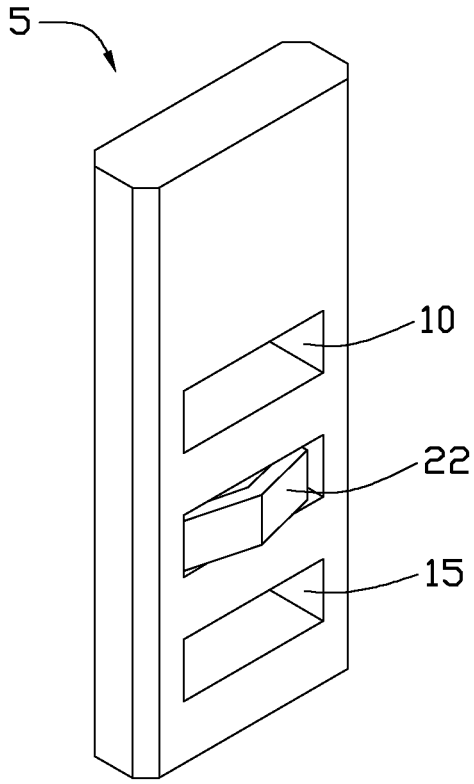
FIG. 2 is an enlarged view of the supporting plate of FIG. 1, but shown from another perspective.

Referring to FIGS. 1 and 2, an exemplary embodiment of a board-to-board connector includes a double plastic pin header connector 6, and a supporting plate 5. The pin header connector 6 includes two opposite positioning plates 60, and a plurality of pin headers 70 longitudinally arranged in two rows, and extending through and fixed to the positioning plates 60. Each positioning plate 60 is made of plastic.

The supporting plate 5 is substantially rectangular, and defines a plurality of through holes, arranged in a row from top to bottom. In one embodiment, the through holes includes a first through hole 10, a second through hole 12, and a third through hole 15. A first elastic piece 20, a second elastic piece 22, and a third elastic piece 24 respectively extend from sidewalls bounding the first through hole 10, the second through holes 12, and the third through hole 15, all are cantilevered. The first elastic piece 20, the second elastic piece 22, and the third elastic piece 24 are substantially V-shaped. Center portions of the first elastic piece 20 and the third elastic piece 25 extend out of a first side surface of the supporting plate 5. A center portion of the second elastic piece 22 extends out of a second side surface of the supporting plate 5, opposite to the first side surface.

Figure 3:
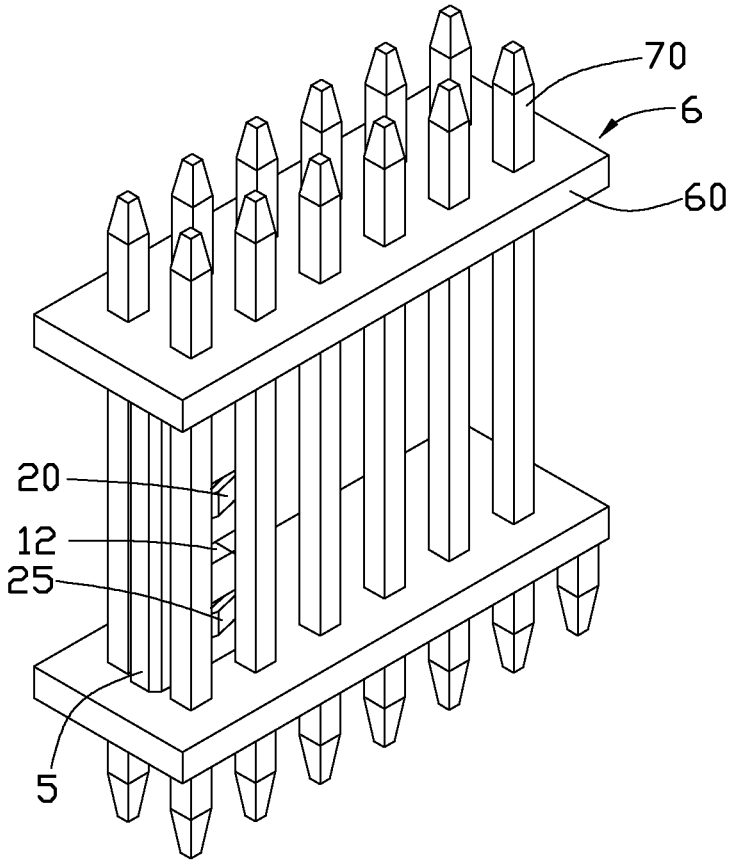
FIG. 3 is an assembled, isometric view of FIG. 1.

Referring to FIG. 3, in assembly, the supporting plate 5 is placed between the positioning plates 60 and entirely enters the two rows of pin headers 70. Opposite ends of the supporting plate 5 respectively resist against the corresponding positioning plates 60. While moving the supporting plate 5, to further enter the two rows of pin headers 70. The first elastic piece 20, the second elastic piece 22, and the third elastic piece 24 are deformed to withdraw in the first through hole 10, the second through hole 12, and the third through hole 15 by pressure of the corresponding pin headers 70, when the first to third elastic pieces 20, 22, and 24 move to the corresponding pin headers 70. After the first to third elastic pieces 20, 22, and 24 move between the two adjacent pin headers 70 of each row, the first elastic piece 20, the second elastic piece 22, and the third elastic piece 24 are restored to elastically resist against the corresponding pin headers 70, to position the supporting plate 5. The opposite ends of the supporting plate 5 resisting against the positioning plates 60 can prevent the pin headers 70 from being deformed.

In other embodiments, the supporting plate 5 may be T-shaped or H-shaped.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

The invention claimed is:

1. A board-to-board connector comprising:

a double plastic pin header connector comprising two opposite positioning plates, and a plurality of pin headers arranged in at least two rows and extending through and fixed to the positioning plates; and a supporting plate arranged between two adjacent rows of the pin headers, with opposite ends of the supporting plate resisting against the positioning plates, respectively;

wherein the supporting plate defines a first through hole and a second through hole, a first elastic piece extending from a sidewall bounding the first through hole out of a first side surface of the supporting plate, a second elastic piece extending from a sidewall bounding the second through hole out of a second side surface of the supporting plate opposite to the first side surface, wherein the first and second elastic pieces elastically resist against corresponding ones of the pin headers.

2. The board-to-board connector of claim 1, wherein the first and second elastic pieces are both substantially V-shaped.

3. The board-to-board connector of claim 1, wherein the supporting plate defines a third through hole, a third elastic piece extends from a sidewall bounding the third through hole out of the first side surface of the supporting plate.

4. The board-to-board connector of claim 3, wherein the third elastic piece is substantially V-shaped.

5. A board-to-board connector comprising:

a double plastic pin header connector comprising two opposite positioning plates, and a plurality of pin headers arranged in at least two rows and extending through and fixed to the positioning plates; and a supporting plate entirely received between two adjacent rows of the pin headers, with opposite ends of the supporting plate resisting against the positioning plates, respectively, wherein two V-shaped elastic pieces extend from and out of two opposite side surfaces of the supporting plate, respectively, and each of the V-shaped elastic pieces elastically resist against adjacent two of the in headers of one row.

6. The board-to-board connector of claim 5, wherein each of the V-shaped elastic pieces is cantilever-shaped with a distal end thereof not touching the supporting plate.

* * * * *